US006497345B1

(12) United States Patent
Wilker et al.

(10) Patent No.: US 6,497,345 B1
(45) Date of Patent: Dec. 24, 2002

(54) DISPENSING APPARATUS

(75) Inventors: Thomas Alan Wilker, Cincinnati, OH (US); Stephan Gary Bush, Sharonville, OH (US); Michael Sean Farrell, Maineville, OH (US); Robert Drennan Lewis, Hamilton, OH (US); Mark John Steinhardt, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/723,875

(22) Filed: Nov. 28, 2000

(51) Int. Cl.[7] ..... B67D 1/07

(52) U.S. Cl. ..... 222/192; 222/181.3; 222/180; 222/130; 242/597.7; 242/597.8

(58) Field of Search ..... 222/192, 181.3, 222/130, 180; 221/96, 199; 242/597.8, 597.7

(56) References Cited

U.S. PATENT DOCUMENTS

| | | | | | |
|---|---|---|---|---|---|
| 1,920,867 | A | * | 8/1933 | Kirk | 221/102 |
| 2,790,608 | A | * | 4/1957 | Sieven | 242/55.3 |
| 3,495,571 | A | * | 2/1970 | Evans | 118/325 |
| 3,639,920 | A | | 2/1972 | Griffin et al. | 4/166 |
| 3,830,198 | A | | 8/1974 | Boone | |
| 3,837,595 | A | | 9/1974 | Boone | 242/55.3 |
| 3,848,822 | A | | 11/1974 | Boone | 242/55.2 |
| 3,865,271 | A | * | 2/1975 | Gold | 221/96 |
| 3,910,229 | A | | 10/1975 | Spencer | |
| 3,943,859 | A | | 3/1976 | Boone | |
| 4,205,802 | A | | 6/1980 | Economakis | |
| 4,235,333 | A | | 11/1980 | Boone | |
| 4,280,643 | A | * | 7/1981 | Cordova et al. | 294/141 |
| 4,747,365 | A | * | 5/1988 | Tusch | 118/221 |
| 4,798,312 | A | | 1/1989 | Scheiber | |
| 4,901,889 | A | | 2/1990 | Mitchell | 222/153 |
| 4,938,384 | A | | 7/1990 | Pilolla et al. | 222/52 |
| 4,964,543 | A | * | 10/1990 | Scheiber | 222/180 |

(List continued on next page.)

FOREIGN PATENT DOCUMENTS

| | | | |
|---|---|---|---|
| CA | 2206000 | 11/1997 | A47K/7/03 |
| CH | 653 874 A5 | 1/1986 | |
| DE | 29719026 U1 | 3/1998 | |
| EP | 1048257 | 11/2000 | |
| WO | WO 96/33647 | 10/1996 | A47K/10/18 |
| WO | WO 99/33008 | 7/1999 | |
| WO | WO 00/35327 | 6/2000 | |
| WO | WO 00/65973 | 11/2000 | |
| WO | WO 00/65974 | 11/2000 | |
| WO | WO 00/65975 | 11/2000 | |

OTHER PUBLICATIONS

PCT International Search Report for PCT/US01/44339 dated Mar. 28, 2002.

PoPoSano™, Moist Cleansing, Inter Proma AG, Pradafant 7, PO Box 1259, FL–9490 Vaduz.

*Primary Examiner*—Henry C. Yuen
*Assistant Examiner*—Frederick C. Nicolas
(74) *Attorney, Agent, or Firm*—Julia A. Glazer; David K. Mattheis; David M. Weirich

(57) ABSTRACT

An apparatus for dispensing paper. The apparatus allows for the use of an existing wall-mounted dispenser without requiring any modification to the existing wall-mounted unit. The apparatus can also be free-standing or portable. The apparatus will accommodate rolled paper or sheets of paper. The apparatus also comprises an automated system for moistening and/or cleansing which enables the user to optionally moisten the paper and/or apply a cleansing agent to the paper if so desired. The degree (i.e.; the amount) of moistening or cleansing agent applied may be controlled by the user.

2 Claims, 6 Drawing Sheets

U.S. PATENT DOCUMENTS 5,012,986 A * 5/1991 Needle ..... 242/55.3
5,312,021 A * 5/1994 Nelson ..... 222/183
5,435,465 A * 7/1995 El-Amin ..... 222/108
5,464,170 A 11/1995 Mitchell et al.
5,465,878 A 11/1995 Armijo et al.
5,697,577 A 12/1997 Ogden ..... 242/598.6
5,704,565 A * 1/1998 Cheng ..... 242/560.2
5,706,986 A * 1/1998 Brandenburg et al. ..... 222/192
5,848,762 A 12/1998 Reinheimer et al.
5,887,759 A 3/1999 Ayigbe ..... 222/192
5,897,074 A 4/1999 Marino
5,950,960 A 9/1999 Marino
5,960,991 A * 10/1999 Ophardt ..... 222/1
6,036,056 A * 3/2000 Lee et al. ..... 222/63
6,056,233 A * 5/2000 Von Schenk ..... 242/594.5
6,059,882 A * 5/2000 Steinhardt et al. ..... 118/264
6,209,752 B1 * 4/2001 Mithell et al. ..... 222/63
6,273,359 B1 * 8/2001 Newman et al. ..... 242/595
6,279,865 B1 * 8/2001 Newman et al. ..... 248/544

* cited by examiner

DISPENSING APPARATUS

FIELD OF THE INVENTION

This invention relates to an apparatus for dispensing paper. This invention is especially useful for dispensing disposable paper products such as tissue and toweling.

BACKGROUND OF THE INVENTION

U.S. Pat. No. 4,901,889 issued to Mitchell on Feb. 20, 1990 purports to teach an apparatus for rotatably mounting a roll of tissue in a holder and for dispensing a flowable substance.

U.S. Pat. No. 5,697,577 issued to Ogden on Dec. 16, 1997 purports to teach an apparatus for dispensing a roll of flushable, premoistened tissue paper.

U.S. Pat. No. 5,887,759 issued to Ayigbe on Mar. 30, 1999 purports to teach a liquid dispenser consisting of an H-shaped structure in which the central section and the end sections together serve as a reservoir for the liquid. The dispenser fits over a roll of toilet tissue and the central section includes a spray pump for directing a fine mist spray onto sheets of toilet tissue.

The drawback of these teachings is that the user has no means to control the degree of tissue moistening. Furthermore, the user is only able to utilize tissue which is in roll form. Yet further, the prior art dispensers are not readily attachable to an existing roll holder and require separate hardware for this purpose. Even further yet, the prior art dispensers require a user to make direct contact with the dispenser in order to moisten the tissue.

The benefits of the present invention include the ability to easily adapt the dispensing apparatus to different dispensing modes (i.e.; the apparatus can be easily attached to an existing roll holder, it can be used as a free-standing dispenser, or it can be used as a portable dispenser). Thus the dispenser is easily attachable and detachable from an existing roll holder and does not require separate hardware for this purpose. Furthermore components such as a moistening and/or cleansing system can be easily adapted to fit the dispenser of the present invention.

Additional benefits of the present invention include enhanced convenience and control for the user. The user controls whether the tissue is used dry or moist. The user also controls the degree to which the tissue is moistened. Furthermore, if the user chooses to moisten the tissue, the process of moistening the tissue can be automated using the dispenser of the present invention. Yet further, the present invention provides a wide variability in the type of moistening/cleansing agent which can be used and the format in which it is applied to the substrate (i.e.; foam, mist, spray, etc.). Yet even further, depending upon the user's preference, the tissue may be dispensed either in roll or discrete sheet form.

Even further yet, the dispensing apparatus can be attached to an existing roll holder without requiring additional hardware, plumbing, or an external power source. Hence, the apparatus can be used without requiring any modification to the existing wall-mounted unit. The apparatus will accommodate rolled paper or sheets of paper. Standard size rolls of paper as well as oversized rolls of paper (for example oversized rolls of bath tissue, paper towel, or the like) can also be used.

The dispensing apparatus also comprises an automated (i.e.; "touchless") system for moistening and/or cleansing which enables the user to optionally apply a cleansing agent to the paper if so desired without the need to contact the dispenser. The amount of cleansing agent applied may be controlled by the user.

SUMMARY OF THE INVENTION

The present invention relates to an apparatus for dispensing disposable paper products. The apparatus comprises an adapter. The adapter is comprised of a top wall, a bottom wall, a front wall, and a back wall all joined together. Both the top wall and the bottom wall comprise an attachment means whereby the top wall of the adapter is attachable to a first dispenser and the bottom wall of the adapter is attachable to a second dispenser.

The adapter may comprise a sleeve which is formed by the walls of the adapter. The sleeve is capable of containing a tissue roll holder spindle. The adapter may be releasably attachable to both the first dispenser and the second dispenser. Preferably the top wall and bottom wall attachment means of the adapter comprise slots and the bottom base of the first dispenser and the top base of the second dispenser comprise protuberances wherein the protuberances of the first dispenser are releasably joined to the slots of the top wall of the adapter and the protuberances of the second dispenser are releasably joined to the slots of the bottom wall of the adapter.

The first dispenser may comprise a disposable paper products dispenser, a cleanser dispenser, or a combination of both. Likewise, the second dispenser may comprise a disposable paper products dispenser, a cleanser dispenser, or a combination of both.

It is preferable that the cleanser dispenser be an automated dispenser which is activated by a user without requiring the user to touch the dispenser.

DETAILED DESCRIPTION OF THE INVENTION

Figure 1:
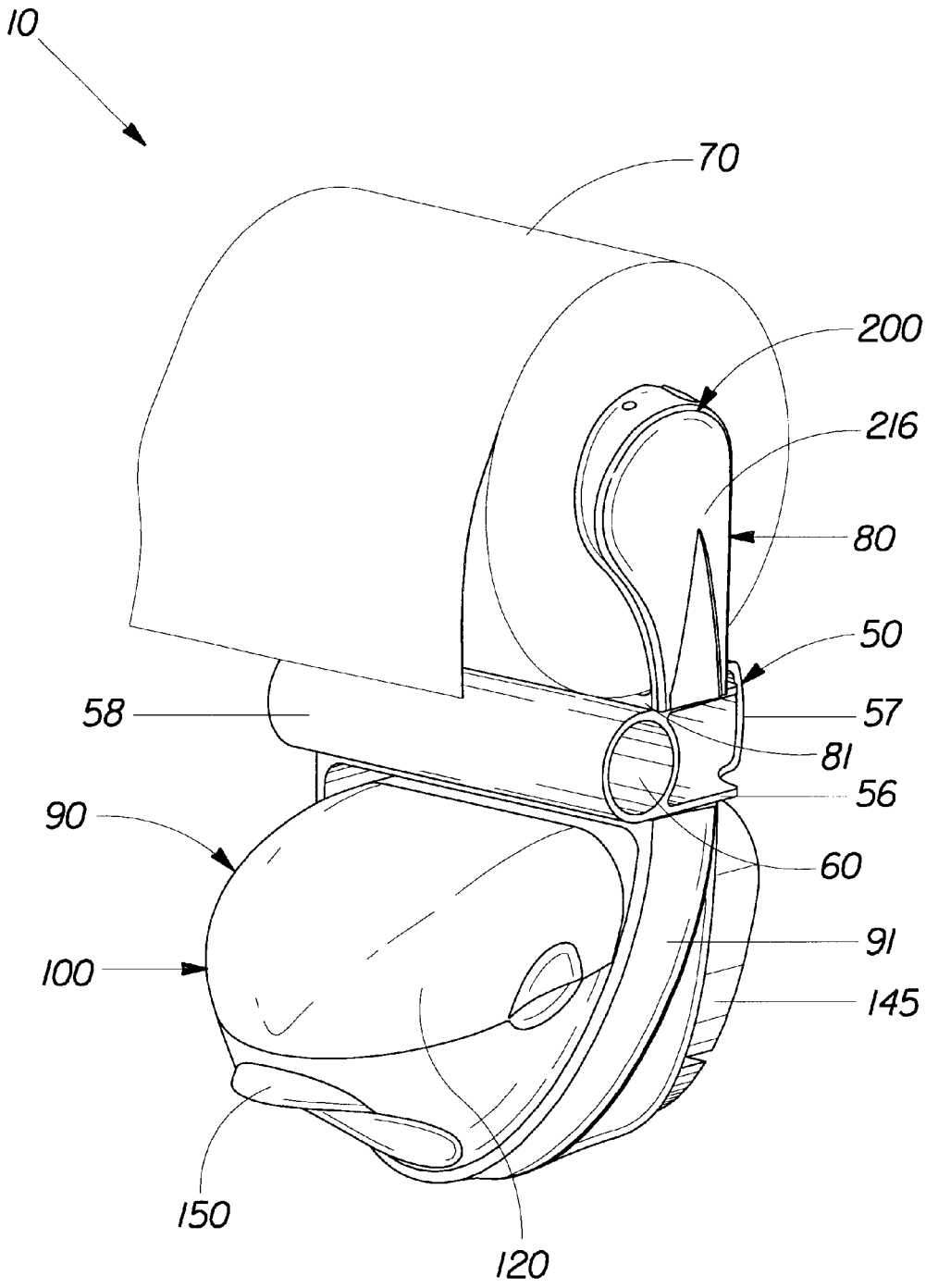
FIG. 1 is a perspective view of one embodiment of a dispensing apparatus according to the present invention.

The present invention relates to a dispensing apparatus utilized for tissue including but not limited to disposable paper products such as toilet paper, facial tissue, wipes, and paper toweling. The tissue may be moistened and/or a cleansing agent applied by the user to facilitate cleaning if the user so desires.

The dispensing apparatus may be a stand alone dispensing apparatus or it may be attached to an existing tissue roll holder in a secured and substantially fixed position. The tissue roll holder is then attached to a wall or other rigid mounting surface without the need for adhesives or the like. As used herein, the term "adhesives" designates substances that bond two materials together by adhering to the surface of each, such as glue, starch paste, mucilage, rubber latex, a synthetic resin composition, cement, adhesive tape, and the like.

Because tissue roll holders such as paper towel and toilet tissue roll holders often extend out from a bathroom wall or are recessed within the wall, the dispensing apparatus is more versatile if attachable to a wide range of such holders. As used herein, the terms "an ordinary wall mounted toilet tissue roll holder", "a toilet tissue roll holder", "a tissue roll holder", or simply "a holder", are used interchangeably and designate a conventional holder for a roll of toilet paper, paper toweling, or similar material whether it is a holder extending out from a wall or a holder recessed within a wall.

Suitable tissue for use with the apparatus of this invention includes but is not limited to tissue made according to commonly assigned U.S. Pat. No. : 3,301,746, issued to Sanford et al. on Jan. 31, 1967; U.S. Pat. No. 3,473,576, issued to Amneus on Oct. 21, 1969; U.S. Pat. No. 3,573,164, issued to Friedberg et al. on Mar. 30, 1971; U.S. Pat. No. 3,812,000, issued to Salvucci et al. on May 21, 1974; U.S. Pat. No. 3,821,068 issued to Shaw on Jun. 28, 1974; U.S. Pat. No. 3,974,025, issued to Ayers on Aug. 10, 1976; U.S. Pat. No. 4,191,609, issued to Trokhan on Mar. 4, 1980; U.S. Pat. No. 4,208,459, issued to Becker et al. on Jun. 17, 1980; U.S. Pat. No. 4,239,065, issued to Trokhan on Dec. 16, 1980; U.S. Pat. No. 4,528,239, issued to Trokhan on Jul. 9, 1985; U.S. Pat. No. 4,529,480, issued to Trokhan on Jul. 16, 1985; U.S. Pat. No. 4,637,859 issued to Trokhan on Jan. 20, 1987; U.S. Pat. No. 5,364,504 issued to Smurkowski et al. on Nov. 15, 1994; and U.S. Pat. No. 5,529,664, issued to Trokhan et al. on Jun. 25, 1996; and U.S. Ser. No. 09/041, 231 filed on Mar. 12, 1998 in the name of Klofta et al., the disclosures of which are incorporated herein by reference.

The tissue for use with the apparatus of this invention may include additives such as but not limited to wet strength agents, temporary wet strength agents, dry strength additives, and softening agents.

The tissue for use with the apparatus of this invention may be dispensed from a roll such as a roll of toilet paper, paper towel, or the like. The tissue may also be dispensed in discrete sheets such as facial tissue, toilet tissue, or the like according to commonly assigned U.S. Pat. No. 4,623,074 issued to Dearwester on Nov. 18, 1986; U.S. Pat. No. 5,332,118 issued to Muckenfuhs on Jul. 26, 1994; U.S. Pat. No. 5,379,897 issued to Muckenfuhs et al. on Jan. 10, 1995; U.S. Pat. No. 5,516,001 issued to Muckenfuhs et al. on May 14, 1996; and U.S. Pat. No. 5,520,308 issued to Berg, Jr. et al. on May 28, 1996, U.S. Pat. No. 6,059,882 issued to Steinhardt et al. on May 9, 2000, the disclosures of which are incorporated herein by reference.

Figure 2:
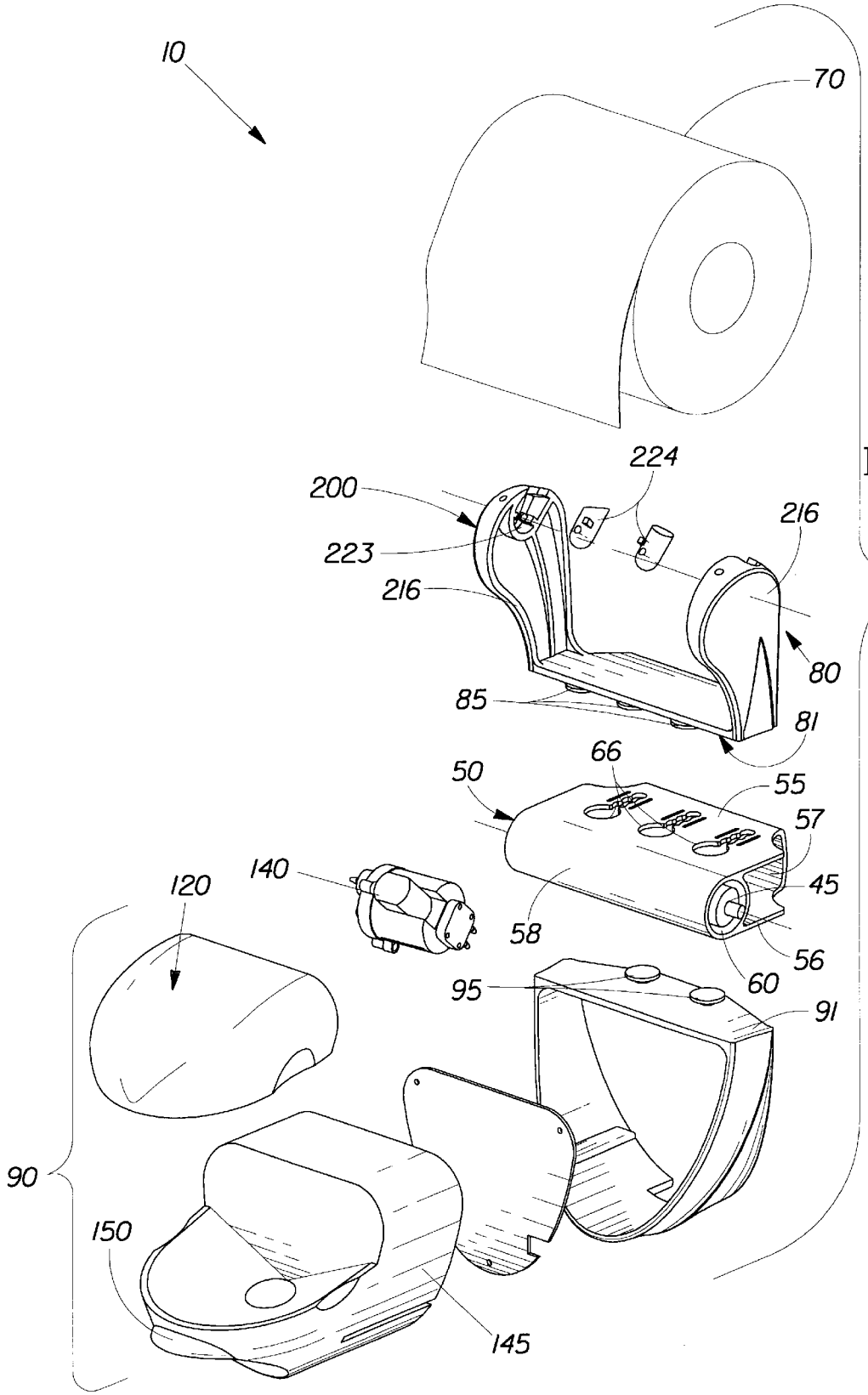
FIG. 2 is an exploded perspective view of the dispensing apparatus of FIG. 1.

Referring now to the drawings in detail wherein the numerals indicate the same element throughout the views, FIG. 1 illustrates a perspective view of one embodiment of the present invention. The dispensing apparatus 10 of FIG. 1 and shown in perspective exploded view in FIG. 2 is comprised of an adapter 50. The dispensing apparatus 10 may also include one or more dispensers which dispense articles such as but not limited to disposable paper products, cleansers, and the like.

Adapter

Figure 2A:
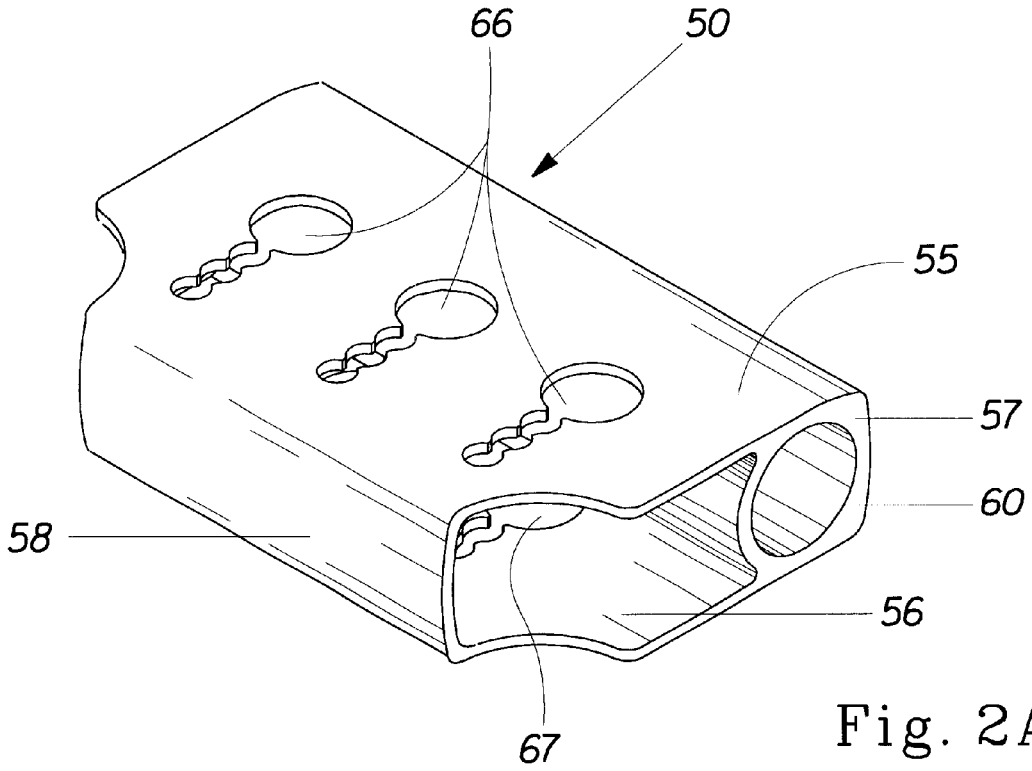
FIG. 2A is a perspective view showing the adapter of FIG. 2 rotated 180° front to back.
Figure 2B:
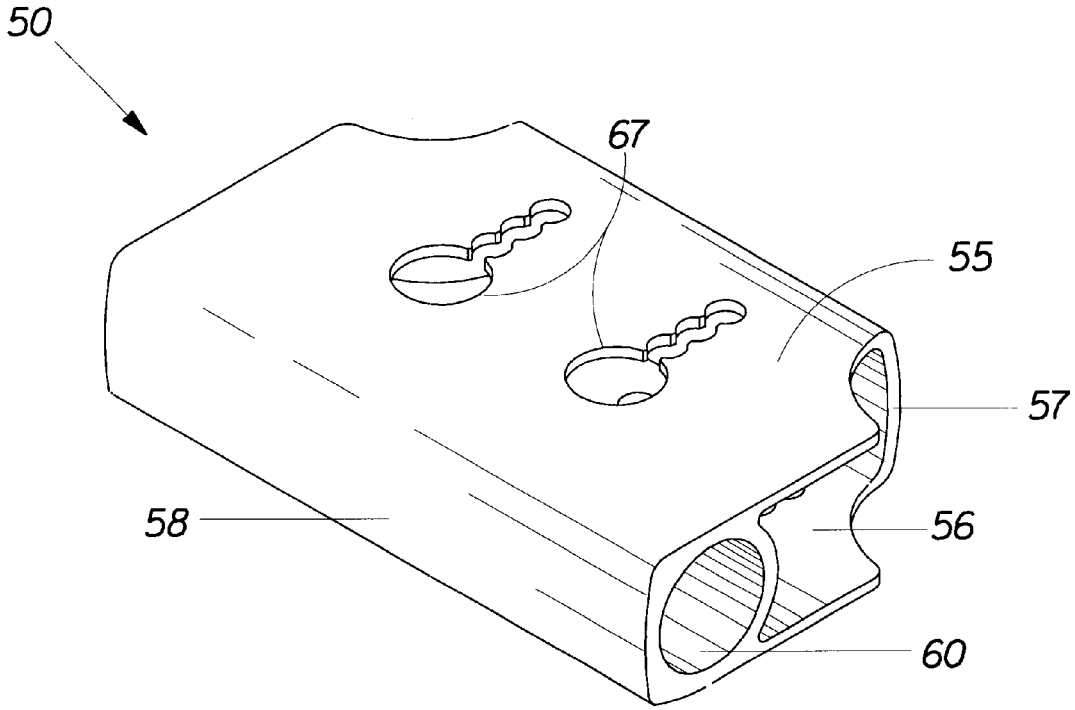
FIG. 2B is a perspective view showing the adapter of FIG. 2 rotated 180° top to bottom.
Figure 5:
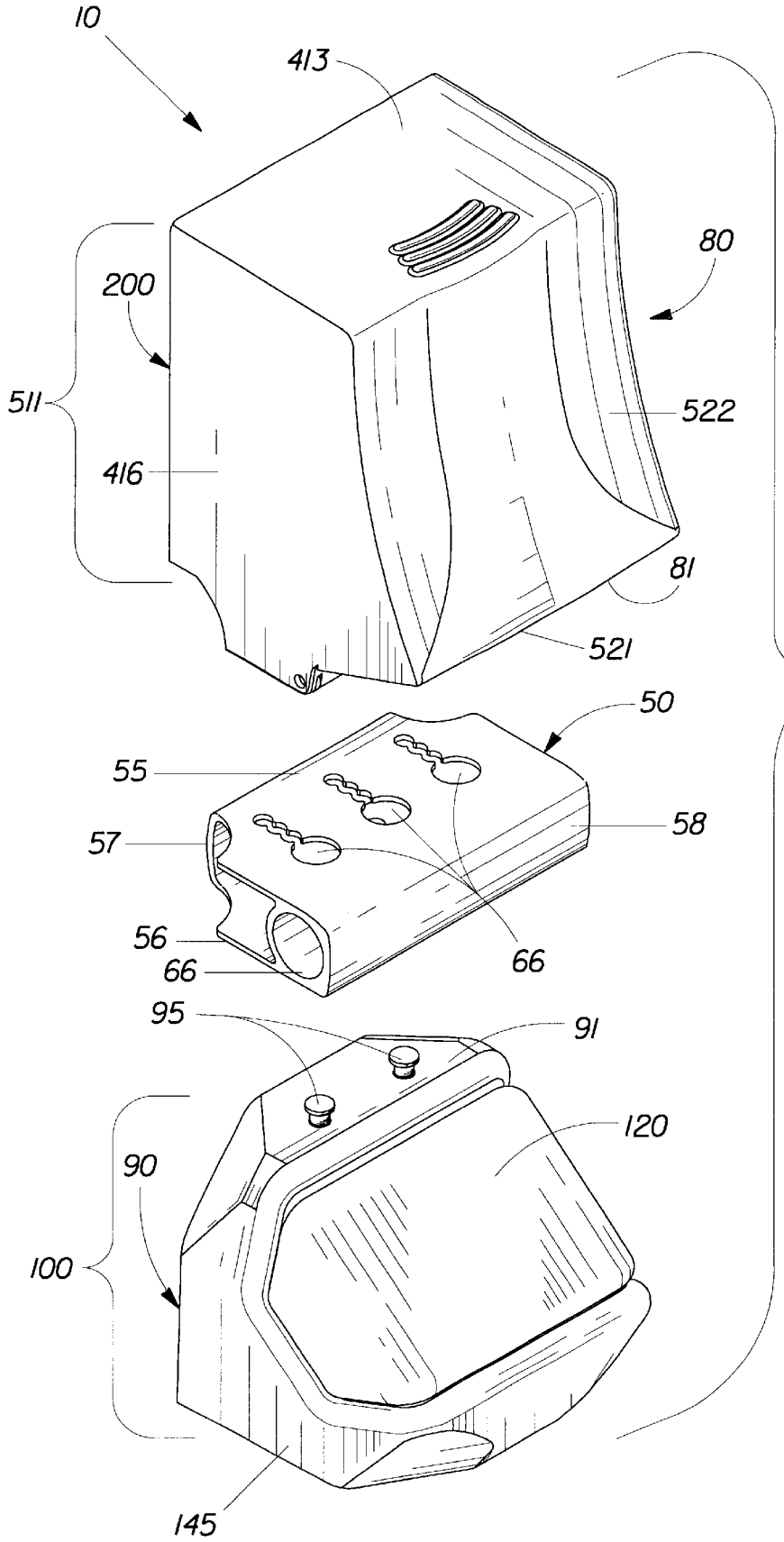
FIG. 5 is a side elevational view showing the dispensing apparatus of FIG. 4.

As shown in FIGS. 2 and 5, the dispensing apparatus 10 adapter 50 serves as a central hub which connects one or more dispensers so as to form a dispensing kit. The adapter 50 then allows all the components of the dispensing apparatus 10 to be attached to an existing roll holder. Alternatively, the dispensing apparatus 10 can be a stand alone unit (not shown). It can also be converted into a portable unit by for example adding a handle thereto (not shown). The configuration of the adapter 50 provides the flexibility to allow it to be used in many different configurations so as to accommodate a variety of existing tissue holders including but not limited to recessed roll holders as well as wall mounted roll holders. The user merely rotates the adapter 50 to the particular position suitable to accommodate a particular existing roll holder. For example, the adapter 50 could be rotated 180° front to back from its position shown in FIG. 2 to that shown in FIG. 2A. As another non-limiting example, the adapter 50 could be rotated 180° top to bottom as shown in FIG. 2B.

In one non-limiting embodiment the adapter 50 comprises a top wall 55, a bottom wall 56, a back wall 57, and a front wall 58 all joined together to form a sleeve 60 as shown in FIGS. 1–5. The sleeve 60 is capable of holding a spindle 45 used for attachment to an existing tissue roll holder.

Both the top wall 55 and the bottom wall 56 of the adapter 50 include an attachment means whereby the top wall 55 and/or the bottom wall 56 can each be attached to separate dispensers. Suitable attachment means include but are not limited to fixed or rigid attachment wherein the attachment between the components of the dispensing apparatus 10 is substantially fixed but preferably are releasably attached wherein the attachment between the components of the dispensing apparatus may be easily attached or detached from one another.

Each separate dispenser includes an attachment means whereby the bottom and/or the top of the dispenser are capable of attachment to the adapter 50. Preferably the components of the dispensing apparatus 10 are releasably attached to one another. Suitable devices for accomplishing this include those which are apparent to one skilled in the art, such as but not limited to the devices described in commonly assigned U.S. Pat. No. 5,618,008 issued to Dearwester et al. on Apr. 8, 1997, the disclosure of which is incorporated herein by reference. Preferred attachment means include opposing protuberances and slots.

Referring to the embodiments shown in FIGS. 1 and 5, the dispensing apparatus 10 includes a first dispenser 80 and a second dispenser 90. The first dispenser 80 and second dispenser 90 are both attached to the adapter 50 by an attachment means. For example, referring to FIGS. 2, 2A, 2B, and 5, the first dispenser 80 has a bottom base 81 which includes protuberances 85. The protuberances 85 of the bottom base 81 of the first dispenser 80 connect to the slots 66 of the top wall 55 of the adapter 50. The second dispenser 90 has a top base 91 which includes protuberances 95 which connect to the slots 67 of the bottom wall 56 of the adapter 50.

Either the first dispenser 80, the second dispenser 90, or both may be used for the purposes of dispensing such articles including but not limited to cleansers, disposable paper products, or a combination thereof.

Cleanser Dispenser

The cleanser dispenser of the present invention can dispense any type of cleansing agent including but not limited to water, soap, or the like, and mixtures thereof. The cleanser may be dispensed in any form including but not limited to a liquid, an emulsion, a solid, a semi-solid, a powder, a foam, or the like, and mixtures thereof.

One type of cleanser dispenser is disclosed in U.S. Pat. No. 6,059,882 issued to Steinhardt et al. on May 9, 2000, the disclosure of which is incorporated herein by reference. Referring to the embodiments shown in FIGS. 1–5, a preferred cleanser dispenser 100 for use with the present invention is an automated touchless cleanser dispenser 100 wherein the user does not have to touch the dispenser in order to activate the dispenser.

A suitable automated touchless cleanser dispenser 100 is comprised of a bottle 120 sufficient to hold the cleanser. The bottle includes an aperture 150 for discharging cleanser from the bottle 120 to the user. The bottle 120 also includes an optional fill cap and optional vent (not shown).

Referring to FIG. 2, the bottle 120 includes a pump 140. The pump may optionally be encased within a pump housing 145. The pump 140 is used to transfer a cleansing agent from the bottle 120 to the user. Suitable pumps for this purpose include but are not limited to gear pumps, centrifigal pumps, and diaphragm pumps. One such suitable pump is a diaphragm pump model NF10KPDC manufactured by KNF Neuberger Incorporated of Trenton, N.J. which delivers a maximum flow of about 100 ml/minute and a maximum pressure of about 103 kPa.

The cleanser dispenser 100 includes a power source. Suitable power sources include but are not limited to electrical power, hydraulic power, solar power, and preferably battery power. Suitable batteries for this purpose include four AA size (i.e.; ANSI/NEDA type 15A or IEC type LR6) alkaline cells providing a source voltage of 6 volts. Other battery combinations and voltages can be used if the control system and motor are suitably matched.

The cleanser dispenser 100 includes a control system for touchless automatic dispensing. One suitable control system comprises the following components: an infrared light source which emits infrared light, a means for detecting the infrared light emitted from the infrared light source such as but not limited to an infrared light sensor, a means for actuating the motor contained within the pump 140 thereby causing liquid and/or air to flow, and a means for timing the actuation of the above pump motor so that the air and/or liquid flows for a predetermined length of time. Other components of the control system which are optional include: a means for the user to adjust the length of time during which liquid and/or air flows, a means to indicate to the user that the batteries are near the end of their useful life, a means to indicate to the user that the pump is being actuated, and a means to inhibit the operation of the cleanser dispenser 100 via the infrared light sensor (e.g.; an "OFF" switch).

Suitable cleansers which may be used in the cleanser dispenser 100 include but are not limited to water, soap, lotion, moisturizers, disinfecting agents, or the like, and personal cleansing products such as those disclosed in commonly assigned U.S. Pat. No. 5,332,118 issued to Muckenfuhs on Jul. 26, 1994 and U.S. Pat. No. 5,525,345 issued to Warner et al. on Nov. 11, 1996, the disclosures of which are incorporated herein by reference. The cleanser may be in the form of a solid, a semi-solid, a powder, a liquid, a foam, or the like and may be dispensed from the cleanser dispenser 100 in like manner. The cleanser dispenser 100 may apply the cleanser to the object in any number of ways including but not limited to spraying, atomizing, misting, foaming, and saturating the object with the cleanser.

A user activates the cleanser dispenser 100 by placing an object such as a sheet of tissue within proximity of a dispenser dispensing sensor (not shown). The sensor, such as an infrared sensor, detects the presence of the object and actuates the pump 140 which in turn withdraws cleanser from the bottle 120 and discharges it through the aperture 150 and onto the tissue. The amount of cleanser dispensed during a single dispensing cycle can be preprogrammed into the dispenser or it can be controlled directly by the user.

Tissue Dispenser

Figure 3:
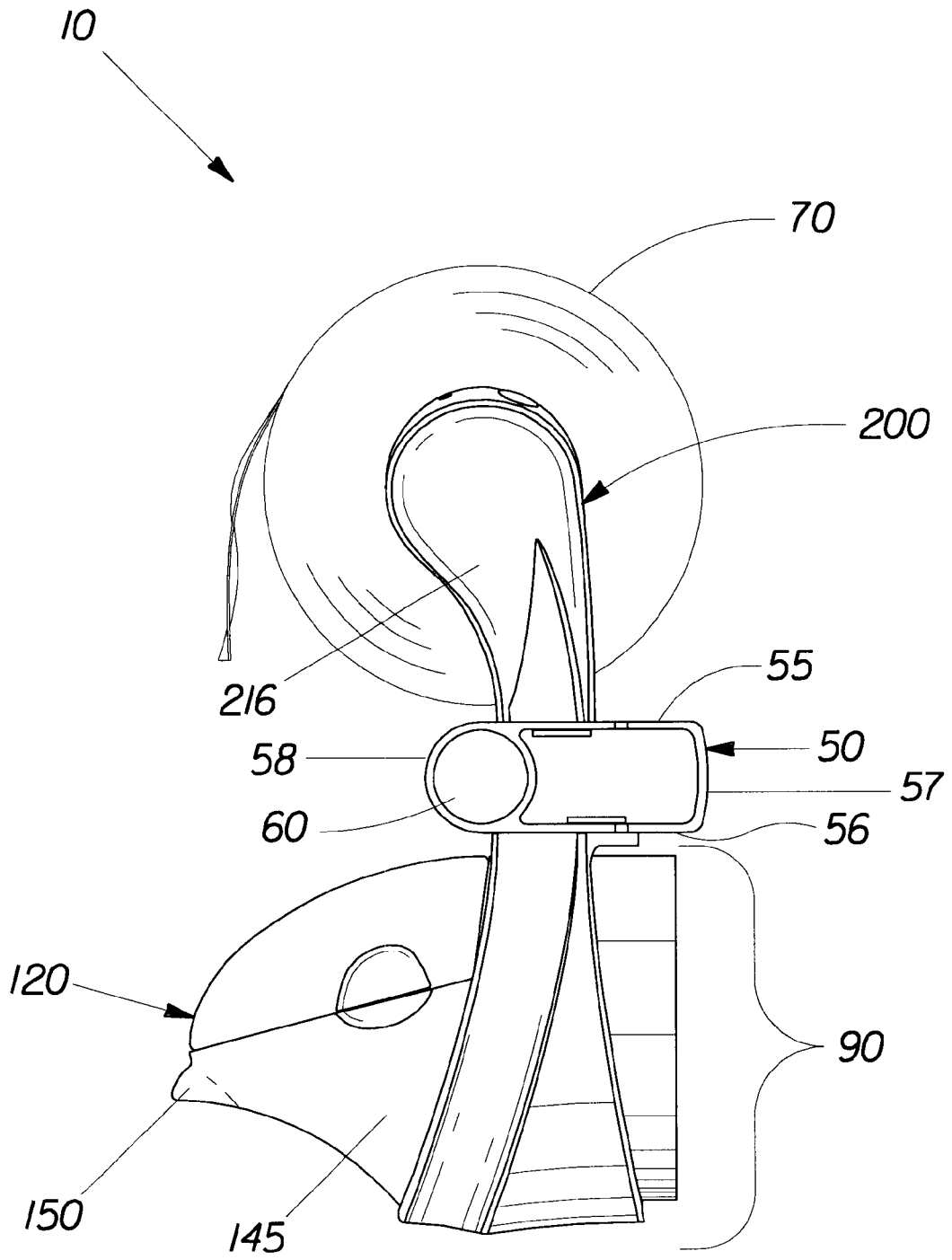
FIG. 3 is a side elevational view showing the dispensing apparatus of FIG. 1.
Figure 4:
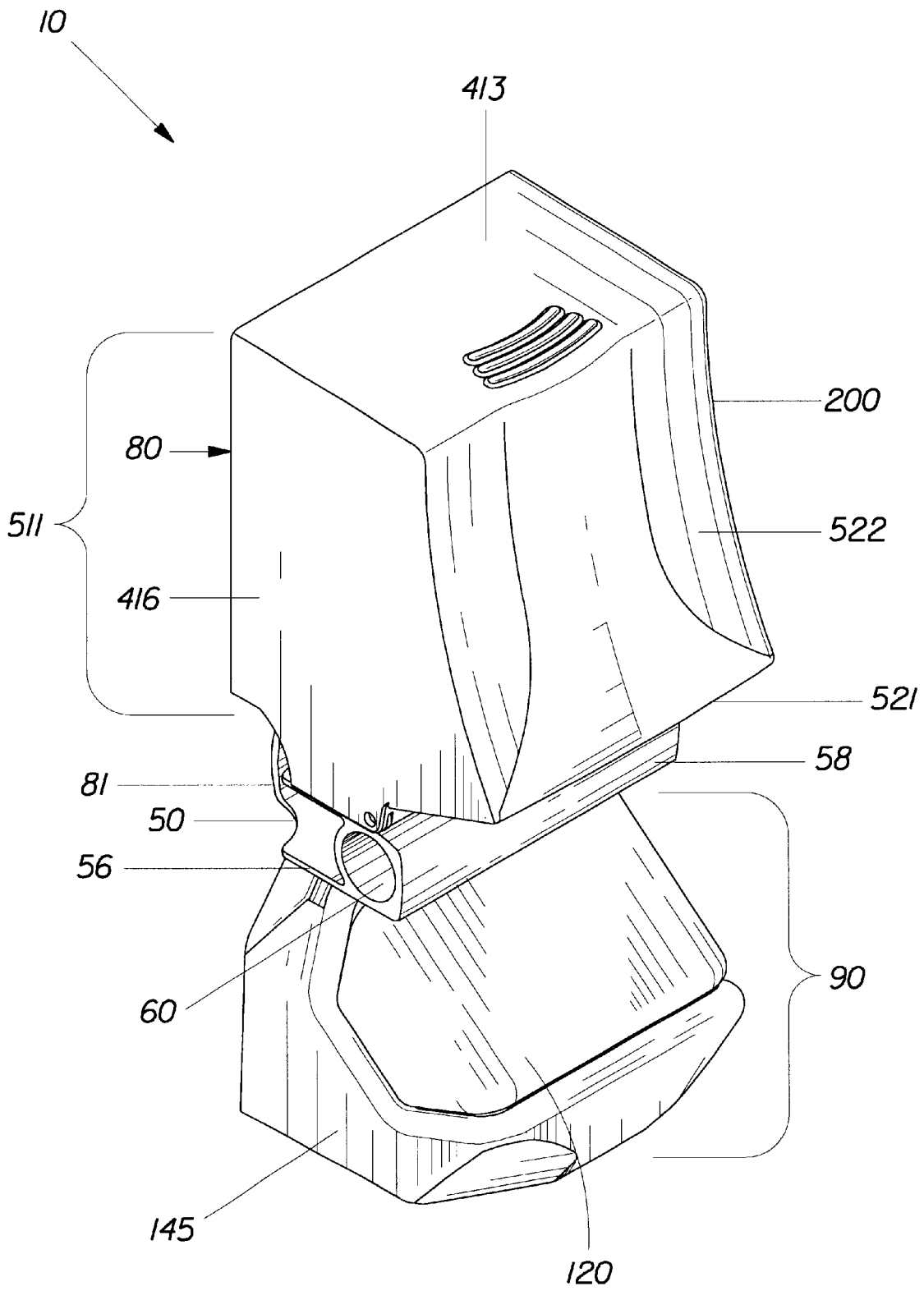
FIG. 4 is a perspective view of another embodiment of a dispensing apparatus according to the present invention.

A suitable tissue dispenser is disclosed in U.S. Pat. No. 6,059,882 issued to Steinhardt et al. on May 9, 2000, the disclosure of which is incorporated herein by reference. One embodiment of a tissue dispenser made according to the present invention is shown in FIGS. 1–3. A second embodiment of a tissue dispenser made according to the present invention is shown in FIGS. 4 and 5.

Referring to FIGS. 1–5, the tissue dispenser 200 will accommodate rolled paper or sheets of paper. Standard size rolls of paper as well as oversized rolls of paper (for example oversized rolls of bath tissue, paper towel, or the like) can also be used.

In one embodiment of the present invention as shown in FIGS. 1–2, the tissue dispenser 200 is comprised of a bottom base 81. Each of the longitudinal ends of the bottom base 81 is defined by side walls 216.

The side walls 216 of the bottom base 81 may be attached to a tissue roll 70. The side walls 216 of the bottom base 81 may be non-removably attached or removably attached. Referring to FIGS. 1–3, the side walls 216 may extend upwardly from the bottom base 81. If desired, they may also extend downwardly, from the bottom base or perpendicular to the bottom base 81. It would be apparent to one skilled in the art that instead of the side walls 216 extending upwardly, downwardly, or perpendicular from the bottom base 81 a separate side arm (not shown) extending upwardly, downwardly, or perpendicular to the bottom base 81 could be attached to each side wall 216.

The side walls 216 may be fixed in place or rotatable about the bottom base 81.

Referring to FIG. 2, each side wall 216 includes an engaging member 223 for receiving at least one roll of tissue 70. As described herein, "engaging member(s)" 223 refers to any device useful for containing or holding rolls of tissue 70 or discrete sheets of tissue 70. For containing rolls of tissue 70, the engaging members 223 can be opposing slots or holes (not shown). Each hole is adapted to receive a spindle having a roll of tissue 70 disposed thereon. The engaging members 223 may also comprise co-extending protuberances 224 as shown in FIG. 2. The co-extending protuberances 224 preferably project towards each other and may or may not touch each other. Each pair of co-extending protuberances 224 is adapted to receive a roll of toilet tissue 70. The engaging members 223 may include other suitable devices which would be apparent to one skilled in the art including those described in U.S. Pat. No. 5,618,008 issued to Dearwester et al. on Apr. 8, 1997 and incorporated herein by reference.

In another embodiment of the present invention shown in FIGS. 5–6 the tissue dispenser 200 is comprised of a top wall 413, a bottom wall, a front wall, a back wall and opposing side walls 416 all joined together to form a casing 511.

Each side wall 416 also includes an engaging member (not shown) for receiving discrete sheets of tissue 70 or at least one roll of tissue 70. For dispensing rolls of tissue 70, the engaging members can be opposing slots, protuberances or holes (not shown) wherein each hole is adapted to receive a spindle having a roll of tissue 70 disposed thereon. For dispensing discrete sheets of tissue 70, the engaging member can be a shelf (not shown) or any other suitable means familiar to one of skill in the art suitable for containing discreet sheets of tissue 70.

Alternatively, the engaging member could be an enclosure 522 as illustrated in FIGS. 4 and 5 useful for containing discrete sheets of tissue 70. Non-limiting examples of discrete sheets of tissue 70 include, facial tissue, toilet tissue, paper towel, and wipes.

The front wall (or any other wall) may be hingedly attached to the enclosure 522 with a hinge or any similar device such that the hingedly attached wall may be opened to permit access to the inside of the enclosure 522. The enclosure 522 also includes a dispensing opening 521 preferably located at the bottom of the enclosure 522 so as to permit a user to withdraw tissue 70 sheets through the dispensing opening 521. In addition to the types of engaging members 223 illustrated here, it would be obvious to one of skill in the art that other devices may be used as suitable engaging members 223.

While particular embodiments of the invention have been illustrated and described, it would be obvious to those skilled in the art that various changes and modifications can be made without departing from the scope and spirit of the invention.

What is claimed is:

1. An apparatus for dispensing disposable paper products, said apparatus comprising:

(a) an adapter, said adapter comprising a top wall, a bottom wall, a front wall, a back wall all joined together, said top wall and said bottom wall comprising attachment means whereby said top wall attachment means is attachable to a first dispenser and said bottom wall attachment means is attachable to a second dispenser; wherein said top wall and said bottom wall attachment means comprise slots whereby said first dispenser comprises a bottom base and said second dispenser comprises a top base whereby said bottom base of said first dispenser and said top base of said second dispenser include protuberances said protuberances of said first dispenser releasably joined to said slots of said top wall of said adapter and said protuberances of said top base of said second dispenser releasably joined to said slot of said bottom wall of said adapter;

(b) a sleeve wherein said sleeve is capable of holding a spindle.

2. The dispensing apparatus of claim 1 wherein said first dispenser or said second dispenser is a touchless cleanser dispenser.

* * * * *